US010132328B2

(12) United States Patent
Cho et al.

(10) Patent No.: US 10,132,328 B2
(45) Date of Patent: Nov. 20, 2018

(54) CENTRIFUGAL FAN

(71) Applicant: LG ELECTRONICS INC., Seoul (KR)

(72) Inventors: Namjoon Cho, Seoul (KR); Kamgyu Lee, Seoul (KR); Dongkeun Yang, Seoul (KR); Baikyoung Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/246,178

(22) Filed: Aug. 24, 2016

(65) Prior Publication Data

US 2017/0058914 A1 Mar. 2, 2017

(30) Foreign Application Priority Data

Aug. 26, 2015 (KR) ..... 10-2015-0120494

(51) Int. Cl.

| | |
|---|---|
| ***F04D 29/42*** | (2006.01) |
| ***F04D 17/16*** | (2006.01) |
| ***F04D 29/44*** | (2006.01) |
| ***F04D 29/66*** | (2006.01) |
| ***F04D 25/08*** | (2006.01) |
| ***F04D 27/00*** | (2006.01) |
| ***F04D 29/28*** | (2006.01) |

(52) U.S. Cl.

CPC ..... *F04D 29/424* (2013.01); *F04D 17/162* (2013.01); *F04D 25/08* (2013.01); *F04D 27/006* (2013.01); *F04D 29/281* (2013.01); *F04D 29/4213* (2013.01); *F04D 29/441* (2013.01); *F04D 29/663* (2013.01)

(58) Field of Classification Search

CPC ..... F04D 29/4226; F04D 29/283; F04D 29/4206; F04D 29/424; F04D 29/403; F04D 29/28; F04D 29/282; F04D 29/281; F04D 25/08; F04D 27/006; F04D 29/663; F04D 29/441; F04D 29/4213; F04D 17/162; F24F 13/20; F05D 2250/711

See application file for complete search history.

(56) References Cited

U.S. PATENT DOCUMENTS 2,932,445 A * 4/1960 Hathaway ..... B23P 15/006 29/513
3,401,871 A * 9/1968 Crowe ..... F04D 17/162 416/178

(Continued)

FOREIGN PATENT DOCUMENTS

CN 1754046 A 3/2006
CN 102536907 A 7/2012

(Continued)

*Primary Examiner* — Justin Seabe
*Assistant Examiner* — Joshua R Beebe
(74) *Attorney, Agent, or Firm* — Dentons US LLP

(57) ABSTRACT

A centrifugal fan including first blades and second blades disposed at both sides of a main plate, respectively, and a first convex part and a second convex part formed at a fan housing to correspond to the first blades and the second blades, respectively, wherein an airflow generated by the first blades and an airflow generated by the second blades are guided to be divided into the first convex part and the second convex part, respectively.

11 Claims, 5 Drawing Sheets

(56) References Cited

U.S. PATENT DOCUMENTS

| | | | | |
|---|---|---|---|---|
| 3,668,887 | A * | 6/1972 | Riello | F24F 1/02 415/121.2 |
| 4,406,585 | A * | 9/1983 | Goettl | F04D 17/04 416/184 |
| 6,109,865 | A * | 8/2000 | Ishikawa | A01G 1/125 415/58.1 |
| 7,549,842 | B2 * | 6/2009 | Hanson | B60H 1/00471 415/204 |
| 7,972,110 | B2 * | 7/2011 | Seki | F04D 29/4226 415/204 |
| 9,086,073 | B2 * | 7/2015 | Iyer | F04D 25/08 |
| 2007/0059167 | A1 | 3/2007 | Hancock | |

FOREIGN PATENT DOCUMENTS

| | | | |
|---|---|---|---|
| CN | 102066598 | A | 3/2013 |
| EP | 1 156 224 | A2 | 11/2001 |
| EP | 2 584 201 | A1 | 4/2013 |
| FR | 2868813 | B1 | 6/2006 |
| JP | 7-224788 | A | 8/1995 |
| JP | 2002-5091 | A | 1/2002 |
| KR | 10-2013-0041639 | A | 4/2013 |

* cited by examiner

CENTRIFUGAL FAN

CROSS-REFERENCE TO RELATED APPLICATION

The application claims priority under 35 U.S.C. § 119 and 35 U.S.C. § 365 to Korean Patent Application No. 10-2015-0120494, filed on Aug. 26, 2015, whose entire disclosure is hereby incorporated by reference.

BACKGROUND OF THE INVENTION

1. Field of the Invention

A centrifugal fan.

2. Description of the Related Art

An air blower is a device to generate an airflow. Such an air blower is used in a variety of industries. In particular, the air blower is applied to an air conditioner for conditioning indoor air to blow air for cooling or heating an indoor space.

The air blower includes a rotation motor and a centrifugal fan rotating at high speed to generate a centrifugal force. In this case, the centrifugal fan exhausts air through centrifugal force out of the centrifugal fan.

The centrifugal fan includes a main plate connected to a rotation axis of the motor, an impeller including a plurality of blades arranged on the main plate in a circumferential direction, and a fan housing providing a space for accommodating the impeller.

The fan housing includes an inlet intaking air in a rotation axis direction, and an outlet exhausting air in a direction perpendicular to the rotation axis after air is extruded in a radial direction by rotation of the impeller. The fan housing has a scroll-shaped flow path between the impeller and the fan housing to guide air toward the outlet.

In the case of a double suction type centrifugal fan or air blower, an impeller includes blades each disposed at both sides of a main plate, and a fan housing includes inlets each disposed at both side of the main plate.

In particular, in the case of the double suction type centrifugal fan (or air blower), an air current is generated by each of the blades at both sides of the main plate. The generated air current is mixed in one space prepared in a fan housing. There may be many problems due to the disturbed air current in the fan housing. In particular, as static pressure of air outside the fan housing is increased, turbulence of air is generated in the fan housing. Thereby, problems, such as generation of abnormal noise, drop of static pressure of air in the fan housing, decrease of air volume, and so on, occur, and, such as, performance or efficiency of the entire fan are decreased.

SUMMARY OF THE INVENTION

Therefore, the present invention has been made in view of the above problems, and it is an object of the present invention a double suction type centrifugal fan capable of improving an airflow in a fan housing.

It is another object of the present invention to provide a centrifugal fan capable of preventing generation of turbulence or abnormal noise.

It is another object of the present invention to provide an air blower preventing abnormal noise.

It is another object of the present invention to provide a centrifugal fan capable of stably securing air volume under high external static pressure.

In accordance with an aspect of the present invention, the above and other objects can be accomplished by the provision of a centrifugal fan including a rotatable impeller, and a fan housing in which the impeller is disposed, the fan housing having first and second inlets intaking air along a rotation axis of the impeller and an outlet exhausting air in a direction perpendicular to the rotation axis, wherein the fan housing includes a first plate having the first inlet, a second plate forming a space with the first plate to accommodate the impeller, the second plate having the second inlet, and a sidewall connecting the first plate to the second plate, the sidewall expanding at an outer side of the impeller in a circumferential direction to guide air flowed through the first and second inlets to the outlet, wherein the impeller includes a main plate having a first side facing the first inlet and a second side facing the second inlet, a plurality of first blades arranged on the first side in a circumferential direction, and a plurality of second blades arranged on the second side in a circumferential direction, wherein the sidewall includes a first convex part protruding away from the rotation axis, the first convex part expanding outside the first blades in a circumferential direction, and a second convex part protruding away from the rotation axis, the second convex expanding outside the second blades in a circumferential direction.

The sidewall may include a curved section wound in a circumferential direction to have a scroll shape, and the first convex part and the second convex part may be formed at the curved section. When the first convex part and the second convex part expand in the rotation direction of the impeller, each of the first convex part and the second convex part in the curved section may include an anticline increase section, where the inner surface is gradually distanced away from the rotation axis, and an anticline decrease section, where the inner surface gradually approaches the rotation axis after passing through the anticline increase section.

When cross-sectional surfaces are provided by cutting the sidewall in a parallel direction with the rotation axis, in each cross-sectional surface, a first maximum convex point, where the inner surface of the first convex part is farthest away from the rotation axis, may be disposed at a section corresponding to a length of each first blade, and in each cross-sectional surface, a second maximum convex point, where the inner surface of the second convex part is farthest away from the rotation axis, may be disposed at a section corresponding to a length of each second blade. In the cross-sectional surfaces, the first maximum convex points may be disposed on a common first plane perpendicular to the rotation axis, and the second maximum convex points may be disposed on a common second plane perpendicular to the rotation axis.

The inner surface of the first convex part and the inner surface of the second convex part may be symmetrical about a certain plane perpendicular to the rotation axis. Each first blade and each second blade may be identical in a length to each other. The first convex part and the second convex part may be connected to each other, and a connecting part between the first convex part and the second convex part may be disposed on a certain plane perpendicular to the rotation axis.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE PREFERRED EMBODIMENTS

Advantages and features of the present invention and a method of achieving the same will be more clearly understood from embodiments described below with reference to the accompanying drawings. However, the present invention is not limited to the following embodiments but may be implemented in various different forms. The embodiments are provided merely to complete disclosure of the present invention and to fully provide a person having ordinary skill in the art to which the present invention pertains with the category of the invention. The invention is defined only by the category of the claims. Wherever possible, the same reference numbers will be used throughout the specification to refer to the same or like elements.

Figure 1:
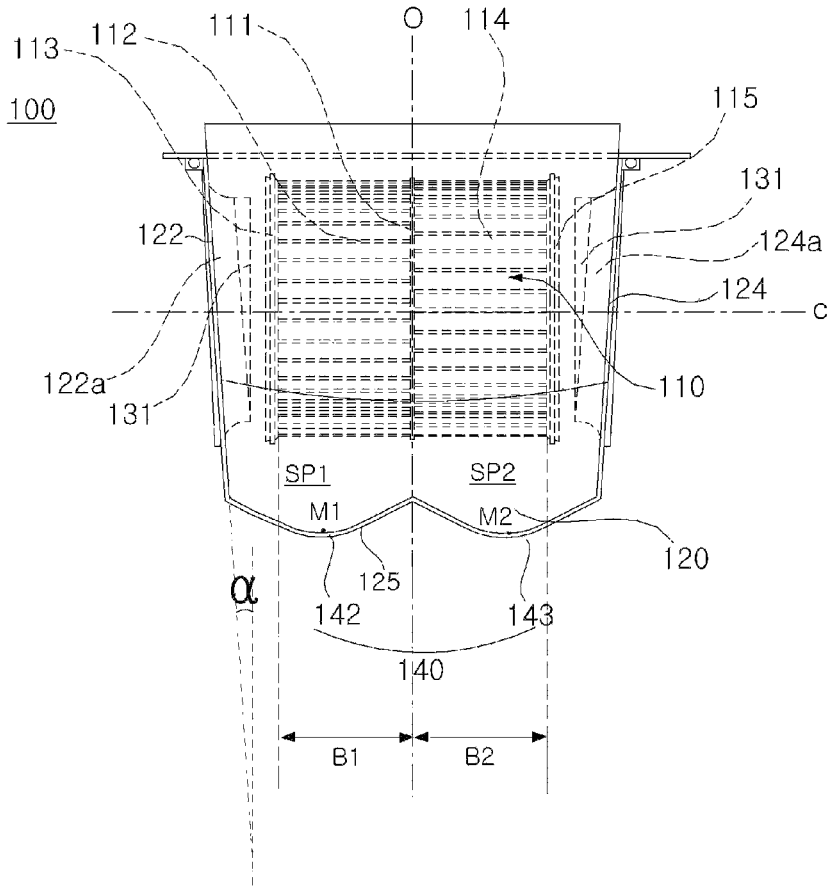
FIG. 1 is a view illustrating a centrifugal fan according to an embodiment of the present disclosure.
Figure 2:
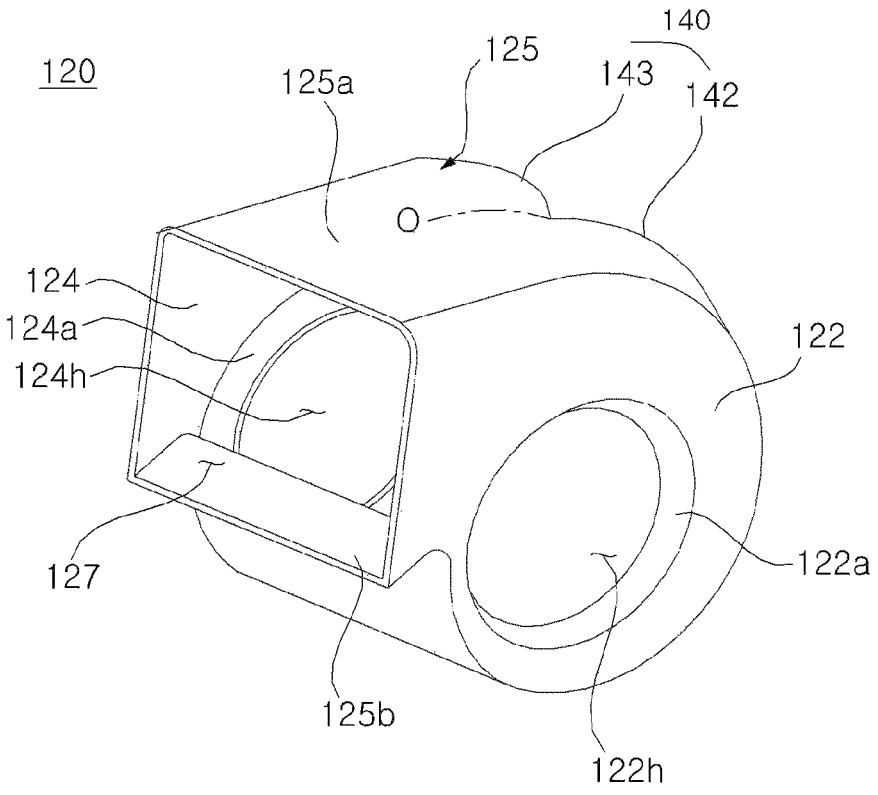
FIG. 2 is a perspective view of a fan housing.
Figure 3:
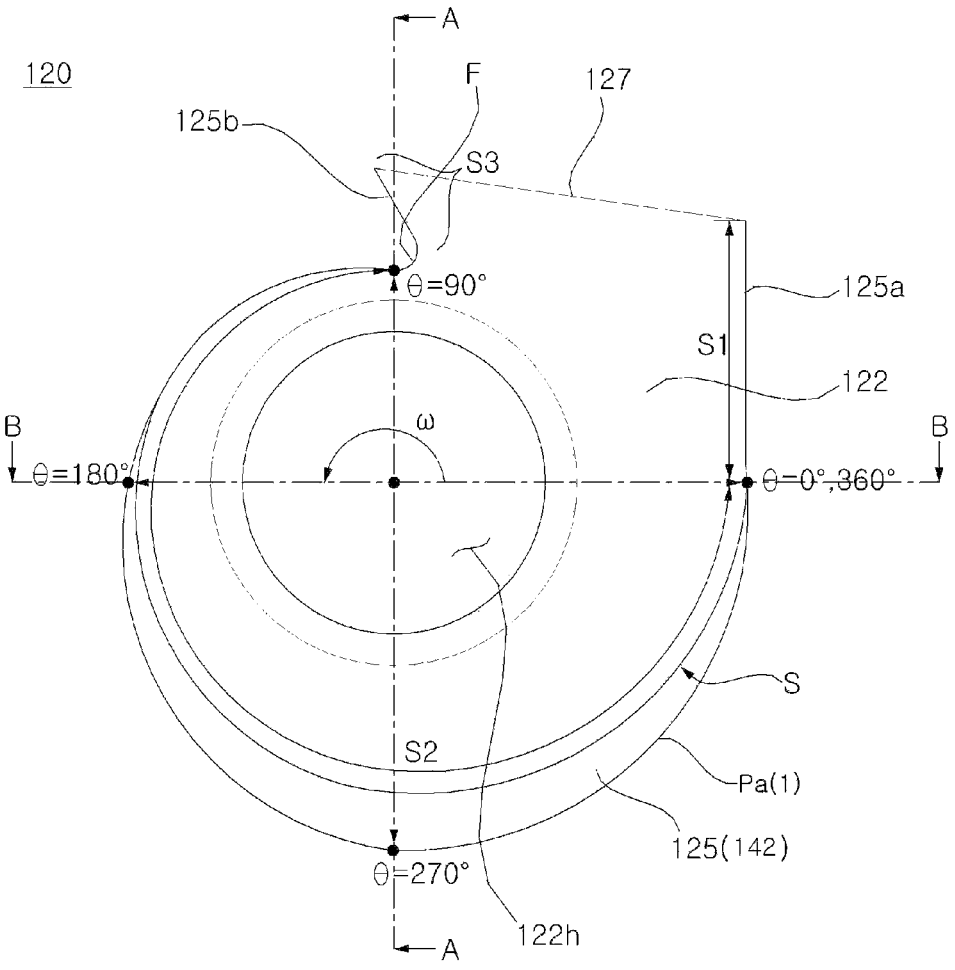
FIG. 3 is a plan view of the fan housing.

FIG. 1 is a view illustrating a centrifugal fan according to an embodiment of the present disclosure. FIG. 2 is a perspective view of a fan housing. FIG. 3 is a plan view of the fan housing.

Referring to FIGS. 1, 2, and 3, the centrifugal fan 100 includes an impeller 110 being rotatably disposed therein and a fan housing 120 in which the impeller 110 is disposed.

The impeller 110 may be rotated by a motor (not shown). "C" shown in FIG. 1 is a rotation axis of the impeller 110. The impeller 110, rotated by the motor, may have a rotation axis expanding along the rotation axis C.

The fan housing 120 may include a pair of inlets 122*h* and 124*h* to intake air along the rotation axis C of the impeller 110, and an outlet 127 to exhaust air in a direction perpendicular to the rotation axis C.

The fan housing 120 may include a first plate 122, at which a first inlet 122*h* is formed, and a second plate 124, at which a second inlet 124*h* is formed. With this configuration, for example, the second plate 124 introduces air in an opposite direction as the first inlet 122*h*. The first plate 122 and the second plate 124 together provide a space to accommodate the impeller 110.

Intake guides 122*a* and 124*a* may be formed at circumferences of the inlets 122*h* and 124*h*, respectively. The intake guides 122*a* and 124*a* may each have a ring-like shape which protrudes inside the fan housing 120. An orifice 131 may be inserted into an inner space surrounded by each of the intake guides 122*a* and 124*a*.

The impeller 110 may include a main plate 111 and a plurality of blades 112 and 114 disposed at both sides of the main plate 111. The main plate 111 may be coupled at the rotation axis C. The main plate 111 may include a first side 111*a* facing the first inlet 122*h* and a second side 111*b* facing the second inlet 124*h* (see e.g., FIG. 4A). A plurality of first blades 112 may be arranged at the first side 111*a* in a circumferential direction. A plurality of second blades 114 may be arranged at the second side 111*b* in a circumferential direction.

One end of each of the first blades 112 may be connected to each other by a ring-shaped first rim 113. One end of each of the second blades may be connected to each other by a ring-shaped second rim 115.

The first plate 112 and the second plate 124 may be connected to each other by a sidewall 125. The sidewall 125 may be formed to expand outside the impeller 110 in a circumferential direction. The sidewall 125 functions to guide air flowed through the first inlet 122*h* and the second inlet 124*h* to the outlet 127.

A distance between the first plate 122 and the second plate 124 may be increased toward the outlet 127 (e.g., the first plate 122 and the second plate 124 become further apart). The first plate 122 and the second plate 124 are preferably symmetrical about a plane O, which is positioned at an equal distance from the first plate 122 and the second plate 124. Each of the first plate 122 and the second plate 124 is disposed at an angle positioned at an equal distance from the first plate 122 and is larger area than the inlets 122*h* and 124*h* such that air is more efficiently diffused and well exhausted through the outlet 127. Thereby, air may be exhausted to the entire space (e.g., an inner space of a casing 2, see FIG. 5), at which the air blower 100*a* is mounted.

As illustrated in FIG. 1, the sidewall 125 may include a first convex part 142 protruding away from the rotation axis C to form a first space SP1 between the first blades 112 and the first convex part 142. In the first convex part 142, a point, which is disposed at an inner surface defining the first space SP1 and is farthest away from the rotation axis C, may be formed to correspond to a section, at which the first blades 112 are disposed.

For example, as illustrated in FIG. 1, cross-sectional surfaces are provided by cutting the fan housing 120 using a particular plane (preferably, a plane including the rotation axis C) in a parallel direction with the rotation axis C. In this case, in the inner surface of the first convex part 142, a point M1 (a first maximum convex point) which is farthest away from the rotation axis C and is on the cross section surface, is disposed at a section B1 to correspond to a length of each of the first blades 112. Namely, when a distance from the first side 111*a* of the main plate 111 in a longitudinal direction of each of the first blades 112 is understood as a height, the first maximum point M1 on the cross-sectional surface is disposed at a height that is less than a length of each of the first blades 112 from the first side 111*a*.

Furthermore, in a cross-sectional view (e.g., FIG. 1) of the fan housing 120, the inner surface of the first convex part 142 may gradually approach the rotation axis C towards both sides of the maximum convex point M1. For example, at one side of the first maximum convex point M1, a point corresponding to the main plate 111 is closest to the rotation axis C. At the other side of the first maximum convex point M1, a point connected to the first plate 122 is closest to the rotation axis C.

The sidewall 125 may include a second convex part 143 protruding away from the rotation axis C to form a second space SP2 between the second blades 114 and the second convex part 143. In the second convex part 142, for example, a point, which is disposed at the inner surface defining the second space SP2 and is farthest away from the rotation axis C, may be formed to correspond to a section, at which the second blades 114 are disposed.

Namely, as illustrated in FIG. 1, cross-sectional surfaces are provided by cutting the fan housing 120 using a particular plane (preferably, a plane including the rotation axis C) in a parallel direction with the rotation axis C. In this case, in the inner surface of the second convex part 143, a point M2 (a second maximum convex point) farthest away from the rotation axis C on the cross section surface is disposed at a section B2 to correspond to a length of each of the second blades 114. Namely, when a distance from the second side 111*b* of the main plate 111 in a longitudinal direction of each of the second blades 114 is understood as a height, the second maximum point M2 on the cross-sectional surface is disposed at a height less that is than a length of each of the second blades 114 from the second side 111*b*.

Furthermore, in a cross-sectional view (e.g., FIG. 1) of the fan housing 120, the inner surface of the second convex part 143 may gradually approach the rotation axis C toward both sides of the maximum convex point M1. For example, at one side of the second maximum convex point M2, a point corresponding to the main plate 111 is closest to the rotation axis C. At the other side of the second maximum convex point M2, a point connected to the second plate 124 is closest to the rotation axis C.

As illustrated, the first convex part 142 and the second convex part 143 may be connected to each other. In this case, in the cross-sectional view of the fan housing 120, the first convex part 142 and the second convex part 143 form a substantially "W" shape. The first convex part 142 and the second convex part 143 are preferably symmetrical about a plane O. In this case, a connecting part between the first convex part 142 and the second convex part 143 may be disposed at a plane (e.g., the plane O) perpendicular to the rotation axis C. The lengths of the first blades 112 and the second blades 114 may be identical.

Figure 4A:
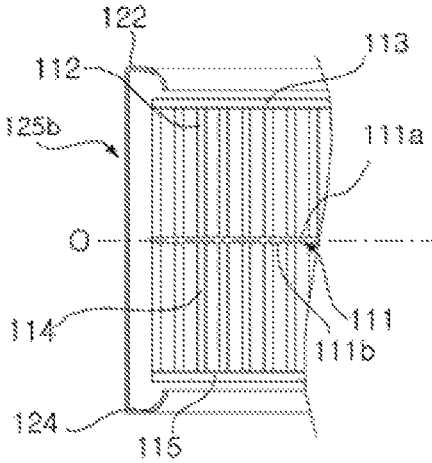
FIG. 4A is a cross-sectional view at a point of θ=90° in the centrifugal fan 100 taken along line A-A of FIG. 3.
Figure 4B:
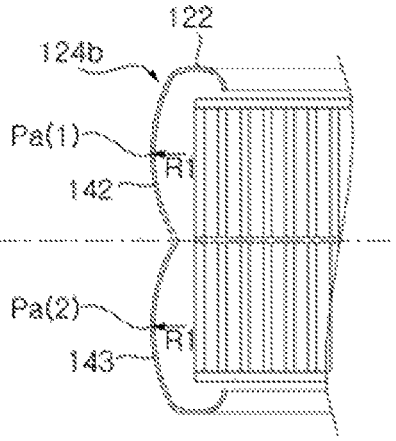
FIG. 4B is a cross-sectional view at a point of θ=180° in the centrifugal fan 100 taken along line B-B of FIG. 3.
Figure 4C:
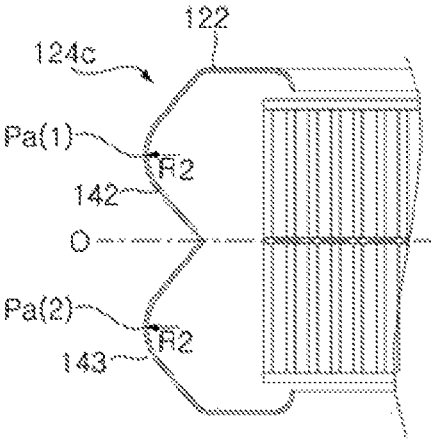
FIG. 4C is a cross-sectional view at a point of θ=270° in the centrifugal fan 100 taken along line A-A of FIG. 3.
Figure 4D:
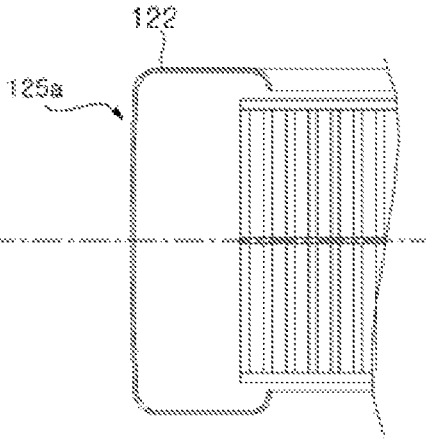
FIG. 4D is a cross-sectional view at a point of θ=0° in centrifugal fan 100 taken along line B-B of FIG. 3.

FIG. 3 shows positions at every 90 degrees in a rotation direction to of the impeller 110 on the basis of a point θ=0° where the convex part 140 and the plane section 125*a* are encountered according to an embodiment of the invention. FIG. 4A is a cross-sectional view at a point of θ=90° in the centrifugal fan 100 taken along line A-A of FIG. 3. FIG. 4B is a cross-sectional view at a point of θ=180° in the centrifugal fan 100 taken along line B-B of FIG. 3. FIG. 4C is a cross-sectional view at a point of θ=270° in the centrifugal fan 100 taken along line A-A of FIG. 3. FIG. 4D is a cross-sectional view at a point of θ=0° in centrifugal fan 100 taken along line B-B of FIG. 3.

Referring to FIG. 3, the sidewall 125 may include a flat plane section 125*a* from the outlet 127 to a certain point and a curved section from the plane section 125*a*. The curved section may be wound in a circumferential direction to have a scroll shape. The first convex part 142 and the second convex part 143 may be formed at the curved section 140.

The fan housing 120 may be configured to have a substantially scroll-shaped flow path (hereinafter, referred to as "scroll flow path") defined by the first plate 122, the second plate 124, and the sidewall 125, outside of the impeller 110. Air moves along the scroll flow path due to rotation of the impeller 110.

A gap between one of outer ends (namely, tailing edges of the blades 122 and 114 in which air current is separated from the blades 122 and 114) of the impeller 100 and an inner surface of the convex parts 142 and 143 is understood as a width of the flow path. In this case, the width of flow path may gradually decreases from the plane section 125*a* along the scroll flow path. As illustrated, the minimum width of the flow path is preferably at a point F where the scroll flow path is terminated. Hereinafter, the point F where the scroll flow path is terminated is referred to as a cut-off point. In the sidewall 125, a section 125*b* from the cut-off point F to the outlet 127 is referred to as a section for guiding air to the outlet 127 (hereinafter, referred to as "diffusion section"). The diffusion section is preferably gradually distanced away from the plane section 125*a* toward the outlet 127.

The first plate 122 and the second plate 124 are preferably shaped substantially identical to each other, and have outer circumferences S corresponding to each of the sections of the sidewall 125, respectively. In detail, for example, each outer circumference S may be divided into a straight section S1 corresponding to the plane section 125*a*, a curved section S2 corresponding to the scroll flow path while expanding from the straight section S1 to the cut-off point F, and an extended section S3 corresponding to the diffusion section 125*b* while expanding from the cut-off point F to the outlet 127.

The outer circumference S of the first plate 122 and the outer circumference of the second plate 124 are preferably shaped substantially identical to each other. Thus, for example, when viewed from the rotation axis C, the outer circumferences of the first and second plates 122 and 124 may completely overlap.

At the curved section S2 constituting the outer circumference S, a distance from the rotation axis C preferably gradually decreases toward the cut-off point F from a point connected to the straight section S1. The curved section S2 may form a spiral of Archimedes or a logarithmic spiral. However, it is understood that the invention is not limited thereto.

As illustrated in FIG. 3, a rotation direction ω of the impeller 110 is a counterclockwise direction on the rotation axis C. Herein, an angle θ which is increased in an opposite direction to the rotation direction ω of the impeller 110 is defined. In this case, a reference for the angle θ is determined at a boundary (θ=0°) encountering the plane section 125*a* to the convex part 140.

Cross-sectional surfaces (e.g., cross-sectional surfaces in FIG. 4) may be provided by cutting the curved section 140 in a parallel direction with the rotation axis C (preferably, a plane including the rotation axis C). In this case, for example, a curve Pa(1) connected to points (namely, the first maximum convex points), where the inner surfaces of the first convex parts 142 are farthest away from the rotation axis C, is positioned on one common first plane perpendicular to the rotation axis C. The first plane may be substantially disposed between the main plate 111 and the first rim 113.

In addition, a curve Pa(2) connected to points, where the inner surfaces of the second convex parts 143 are farthest away from the rotation axis C, may be positioned on one common second plane that is perpendicular to the rotation axis C. The second plane may be substantially disposed between the main plate 111 and the second rim 115.

Meanwhile, the cut-off point F may be disposed in the proximity of a point of θ=90°. For example, at an opposite side to the cut-off point F based on a rotation central point of the impeller 110, each of the inner circumferential surfaces of the convex parts 142 and 143 has a maximum distance from the rotation axis C. The maximum convex point is thus disposed between a point of θ=180° and a point of θ=360°. In the illustrated embodiment, for example, the maximum convex point is disposed in the proximity of a point of θ=270°. However, it is understood that the invention is not limited thereto.

According an embodiment of the invention, each of the convex parts 142 and 143 starts between a point of θ=90° and a point of θ=180°. Each of the convex parts 142 and 143 may expand in the rotation direction ω of the impeller 110.

The maximum convex point may be gradually distanced away from the rotation axis C up to a point. For example, the radius of curvature of each of the curves Pa(1) and Pa(2) may gradually decrease from a point where each of the convex parts 142 and 143 starts (see e.g., FIG. 4A). The minimum radius of curvature of each of the curves Pa(1) and Pa(2) may be at a point where a distance from the rotation axis C is maximum (the radius of curvature is R2). The radius of curvature of each of the curves Pa(1) and Pa(2) may gradually increase to a point (e.g., FIG. 4D) where the convex parts 142 and 143 terminate (R1>R2, R2=minimum radius of curvature).

Moreover, each of the first convex part 142 and the second convex part 143 may include an anticline increase section (e.g., a section of 90°<θ<270° in FIG. 3) in which the inner surface is gradually distanced away from the rotation axis C, and an anticline decrease section (e.g., a section of 270°<θ<360° in FIG. 3) where the inner surface gradually approaches the rotation axis C at a portion beyond the anticline increase section.

The first convex part 142 and the second convex part 143 may be formed at the sidewall 125 and extend the inner space of the scroll flow path such that air forced by the impeller 110 is efficiently transferred. In particular, for example, with such configuration, air exhausted by the impeller 110 will not rapidly collide with an inner surface of the sidewall 125 in the convex section 140 such that a direction of air flow is smoothly switched along the inner surface. Thereby, loss of the airflow decreases and efficiency of air blower is improved.

The impeller generates the airflow by the first blades 112 and the airflow by the second blades 114 at both sides of the main plate, respectively. In this case, for example, the airflow generated by each of the blades 112 and 114 is guided so as to be divided into the first convex part 142 and the second convex part 143. As a result, turbulence of air due to collision between airflows decreases. Air in each of the convex parts 142 and 143 moves along the scroll flow path while forming a smooth velocity gradient, and thus, noise decreases. In particular, both airflows based on the main plate 111 become uniform and, as such, air is uniformly exhausted through the outlet 127.

In addition, because the air smoothly flows in the convex parts 142 and 143, pressure loss is reduced or prevented. Also, high pressure may be entirely maintained at the inner circumferential surface of the sidewall 125 and the entire fan housing 120.

Figure 5:
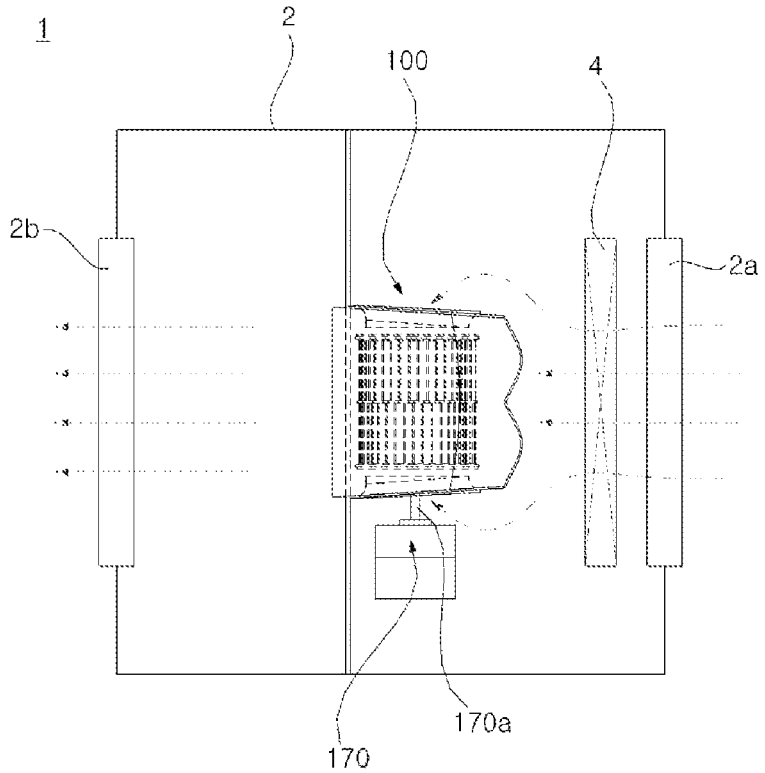
FIG. 5 is a view illustrating an air conditioner according to an embodiment of the present disclosure.

FIG. 5 is a view illustrating an air conditioner according to an embodiment of the present disclosure. Referring to FIG. 5, the air conditioner 1 includes a motor 170 and a centrifugal fan 100 driven by the motor 170. Hereinafter, the same components as the above-described components are given the same reference numerals. A description thereof is the same as the above description and is omitted.

The air conditioner 1 may include a casing 2 providing a space to accommodate the centrifugal fan 100 and the motor 170. The casing 2 may also accommodate a heat exchanger 4. The casing 2 may further include an intake port 2*a* to intake external air (indoor or outdoor air) and a conditioned air exhaust port 2*b* contacting to the heat exchanger 4 in the casing 2 while exhausting temperature-controlled air to an indoor space. Air flowed into the casing 2 through the intake port 2*a* thus passes through the heat exchanger 4 to control the temperature of air. Then, air forced by the air blower 100*a* is exhausted through the conditioned air exhaust port 2*b* to the indoor space.

The air conditioner 1 may further include a heat pump. The heat exchanger 4 may constitute the heat pump. The heat exchanger 4 cools or heats air, which flows to the centrifugal fan 100, using heat exchange of air in the casing 2. The heat pump is preferably configured to circulate a coolant using a compressor (not shown) along an enclosed pipe forming a closed loop. The heat exchanger 4 is preferably configured to be a part of the enclosed pipe. In this case, the coolant exchanges heat with air of the casing 2 while passing through the heat exchanger 4.

Upon cooling the indoor space (an air conditioner only for cooling or in a cooling mode of an air conditioner for cooling or heating), the heat exchanger 4 functions as an evaporator to evaporate the coolant. Upon heating the indoor space (an air conditioner only for heating or in a heating mode of an air conditioner for cooling or heating), the heat exchanger 4 functions as a condenser to condense the coolant. It is understood that the air conditioner 1 according to the present disclosure may include known various types heaters or coolers (e.g., a water-cooled cooler) to heat or cool air of the casing 2, and is not limited to the above embodiment.

The motor 170 may include a rotation axis 170*a* arranged along the rotation axis C of the centrifugal fan 100. The rotation axis 170*a* may be coupled to the main plate 111. The motor 170 may be disposed at any one inlet of both inlets of the centrifugal fan 100.

As apparent from the above description, in accordance with the air blower and the air conditioner of the present invention, the impeller rotates in a balanced manner since air is uniformly flowed through both inlets.

Additionally, the airflow generated by the blades disposed at both sides of the main plate is guided to be divided into the first convex part and the second convex part, and, as such, turbulence due to collision between the airflows may be decreased.

Additionally, air in the convex parts formed at the fan housing moves along the scroll flow path while forming smooth velocity gradient, thereby noise is decreased.

Additionally, both airflows based on the main plate become uniform, and thus, air is uniformly exhausted through the outlet.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A centrifugal fan comprising:

a rotatable impeller; and a fan housing to accommodate the impeller, the fan housing having a first inlet and a second inlet to respectively intake air along a rotation axis of the impeller, and an outlet to exhaust air in a direction perpendicular to the rotation axis, wherein the fan housing comprises:

a first plate having the first inlet, a second plate forming a space with the first plate to accommodate the impeller, the second plate having the second inlet, and a sidewall connecting the first plate to the second plate, the sidewall expanding at an outer side of the impeller in a circumferential direction to guide air flowed through the first and second inlets to the outlet, wherein the impeller comprises:

a main plate having a first side facing the first inlet and a second side facing the second inlet, a plurality of first blades arranged at the first side in a circumferential direction, and a plurality of second blades arranged at the second side in a circumferential direction, and wherein the sidewall comprises:

a first convex part protruding away from the rotation axis, the first convex part expanding outside the first blades in a circumferential direction, and a second convex part protruding away from the rotation axis, the second convex part expanding outside the second blades in a circumferential direction, wherein the sidewall comprises a curved section extending in a circumferential direction, and the first convex part and the second convex part are formed at the curved section such that each of inner circumferential surfaces of the first convex part and the second convex part forms a curved surface, wherein, the first convex part and the second convex part are connected to each other, and on an inner circumferential surface of the sidewall, a connecting part between the inner circumferential surface of the first convex part and the inner circumferential surface of the second convex part is closest to the rotation axis, wherein a first space between the first blades and the first convex part and a second space between the second blades and the second convex part are communicated with each other through a clearance between the connecting part and the impeller, wherein the curved surface of the first convex part includes a first section which comes closer to the rotation axis toward an opposite side of the first plate, wherein the curved surface of the second convex part includes a second section which comes closer to the rotation axis toward an opposite side of the second plate, and wherein the connecting part is defined where the first section and the second section meet.

2. The centrifugal fan of claim 1, wherein the first convex part and the second convex part respectively expand in the rotation direction of the impeller.

3. The centrifugal fan of claim 2, wherein each of the first convex part and the second convex part in the curved section comprises an anticline increase section, where the inner surface is gradually distanced away from the rotation axis, and an anticline decrease section, where the inner surface gradually approaches the rotation axis after passing through the anticline increase section.

4. The centrifugal fan of claim 1, wherein the cross-sectional surfaces are provided by cutting the sidewall in a parallel direction with the rotation axis.

5. The centrifugal fan of claim 4, wherein at each cross-sectional surface, a first maximum convex point is disposed at a section corresponding to a length of each first blade, whereby the inner surface of the first convex part is farthest away from the rotation axis.

6. The centrifugal fan of claim 5, wherein at each cross-sectional surface, a second maximum convex point is disposed at a section corresponding to a length of each second blade, whereby the inner surface of the second convex part is farthest away from the rotation axis.

7. The centrifugal fan of claim 6, wherein, in each of the cross-sectional surfaces, the first maximum convex point is disposed at a common first plane perpendicular to the rotation axis, and the second maximum convex point is disposed at a common second plane perpendicular to the rotation axis.

8. The centrifugal fan of claim 6, wherein the inner surface of the first convex part and the inner surface of the second convex part are symmetrical about a plane perpendicular to the rotation axis.

9. The centrifugal fan of claim 8, wherein a length of each of the plurality of first and second blades is identical.

10. The centrifugal fan of claim 5, further comprising:

a connecting part provided between the first convex part and the second convex part, the connecting part being disposed at a plane perpendicular to the rotation axis.

11. The centrifugal fan of claim 1, wherein the impeller generates airflow by the plurality of first and second blades at both sides of the main plate, whereby the airflow generated by each of the plurality of first and second blades is divided into the first convex part and the second convex part.

* * * * *